United States Patent [19]

Barends et al.

[11] 4,301,943

[45] Nov. 24, 1981

[54] MELAMINE CONTAINER AND PROCESS FOR UNLOADING SAME

[75] Inventors: Willem J. Barends, Limbricht; Alexis J. W. van Mulken, Brunssum, both of Netherlands

[73] Assignee: Stamicarbon, B.V., Geleen, Netherlands

[21] Appl. No.: 40,151

[22] Filed: May 17, 1979

[30] Foreign Application Priority Data

Dec. 30, 1978 [NL] Netherlands ..... 7812680

[51] Int. Cl.[3] ..... B67B 7/00; A01C 15/04

[52] U.S. Cl. ..... 222/1; 222/166; 222/410; 222/617; 222/630; 406/98; 406/102; 406/103; 406/195; 414/489; 414/507; 298/7

[58] Field of Search ..... 222/410, 1, 617, 630, 222/166; 298/7; 414/489, 507; 406/98, 102, 103, 195; 239/654, 655

[56] References Cited

U.S. PATENT DOCUMENTS 3,578,213 5/1971 Clarke ..... 222/95
4,114,955 6/1977 Araoka ..... 406/122

FOREIGN PATENT DOCUMENTS 262899 3/1965 Australia ..... 298/7
1100139 1/1968 United Kingdom .

*Primary Examiner*—Allen N. Knowles
*Attorney, Agent, or Firm*—Cushman, Darby & Cushman

[57] ABSTRACT

Process and apparatus for unloading melamine powder from a bulk shipping or transporting containers. The apparatus is comprised of a uniquely designed portable hopper or discharge chute provided at its discharge end with a rotary pump that is removably attachable to a tiltable bulk container. The process of unloading the bulk container involves the creating of a particular shaped flow from the bulk container so that bridging and other flow problems associated with flowing melamine powder does not occur.

16 Claims, 3 Drawing Figures

MELAMINE CONTAINER AND PROCESS FOR UNLOADING SAME

BACKGROUND OF PRESENT INVENTION

This invention relates to a process and apparatus for unloading melamine powder from a bulk container.

Up until now, the most usual and customary way to transport melamine powder was in the form of individual 25 to 50 kg. bags. Thus, transfer of large volumes of melamine powder could only be accomplished when many such bags were loaded onto pallets and placed in that form into a large shipping container. Additionally, for melamine of a quality that shows no "baking" properties, melamine powder has, at time, been transported in what have been referred to in the industry as bulk bags which are really 1500 kg. bags. (Intermediate Bulk Containers). AGain to ship large quantities of melamine powder a number of such bags would have to be loaded on pallets and shipped as are the 25 to 50 kg. bags.

As is evident such bagging procedures increase the production and transportation costs because of the bagging procedures that must be observed. Not only does bagging increase the cost of preparing shipments for transportation but in addition increase unloading costs since such shipments require more labor and time in unbagging procedures. In addition, any imperfections in the bagging procedure or any ripping of bags during the moving, loading, unloading of such bags can also result in certain losses of melamine powder. Each of these particular occurrences are not desirable and each of these problems is substantially eliminated by the present invention.

Certain known bulk melamine transport containers are also known but these are specially constructed tank trailers. These have been specifically designed and are useful only for transporting melamine and are not useful for transporting other substances or materials so that while trucks can transport melamine in one direction they are not available for carrying return freight and must deadhead back for another shipment of melamine. This is of course an inefficient use of trucks and substantially increases shipping costs.

By in large the most economical and efficient way of transporting melamine powder, specially for overseas transport, would be in the form of bulk cargo in trailer trucks or other large quantity containers, sometimes referred to as ISO-Containers.

Some melamine powders presently on the market exhibit better flow rates than other types but regardless, melamine is very fine and certain flow problems can result. Among these, are bridging which occurs when a quantity of melamine powder forms an arch or bride capable of supporting a quantity of melamine there above while allowing the melamine there below to fall away from beneath. Another problem characteristic of some melamine powders is rat holing where only a narrow flow opening occurs within a bulk supply of melamine powder so that the majority of the powder will not be flowing. Accordingly, certain problems can arise when trying to unload melamine powder from extremely large bulk containers. Further, it is not unusual for melamine to block the very means used to receive the melamine powder flowing from containers so that further transportation of melamine is not possible. Accordingly, it is not possible to pour melamine directly from a bulk container with only a funnel type of device for directing the flow of melamine powder.

Furthermore, it is not possible to dispense with a device for directing the flow of melamine, as this requires the presence of an expensive underground warehouse, and the flow of melamine from the container into the warehouse gives rise to much dust, loss of melamine and contamination thereof.

SUMMARY OF THE PRESENT INVENTION

The bulk container contemplated for use in the present invention is a large dumpable type of container or trailer truck which can be adjusted at various dumping angles and is provided with an opening in its rear wall.

The present invention also includes a uniquely designed portable hopper or discharge chute assembly designed to be easily and removably attachable to the rear wall of the container or trailer truck so that the opening in the container's rear wall is aligned with the discharge chute assembly. The discharge chute assembly itself is comprised of a hopper portion directly attachable to the container, a rotary pump assembly, and a connector portion which serves to connect the hopper portion with the rotary pump assembly. Both the hopper and connector portions are built with their walls at particular angles which are essential in preventing the above described flow problems frequently associated with melamine powder and serve to provide a constant flow so that it is possible to effectively and efficiently empty a bulk container such as the trailer truck referred to in this invention. It should be understood, that while references to the bulk shipping container are made primarily with respect to a tractor trailer truck type of container, other large bulk containers would also be properly included within the scope of this present invention.

DESCRIPTION OF THE DRAWINGS

Other objects and characteristics of the present invention will be more fully understood when the following detailed specification is read together with the drawings included herewith which show.

DETAILED DESCRIPTION OF THE PREFERRED EMBODIMENT OF THE PRESENT INVENTION

Figure 1:
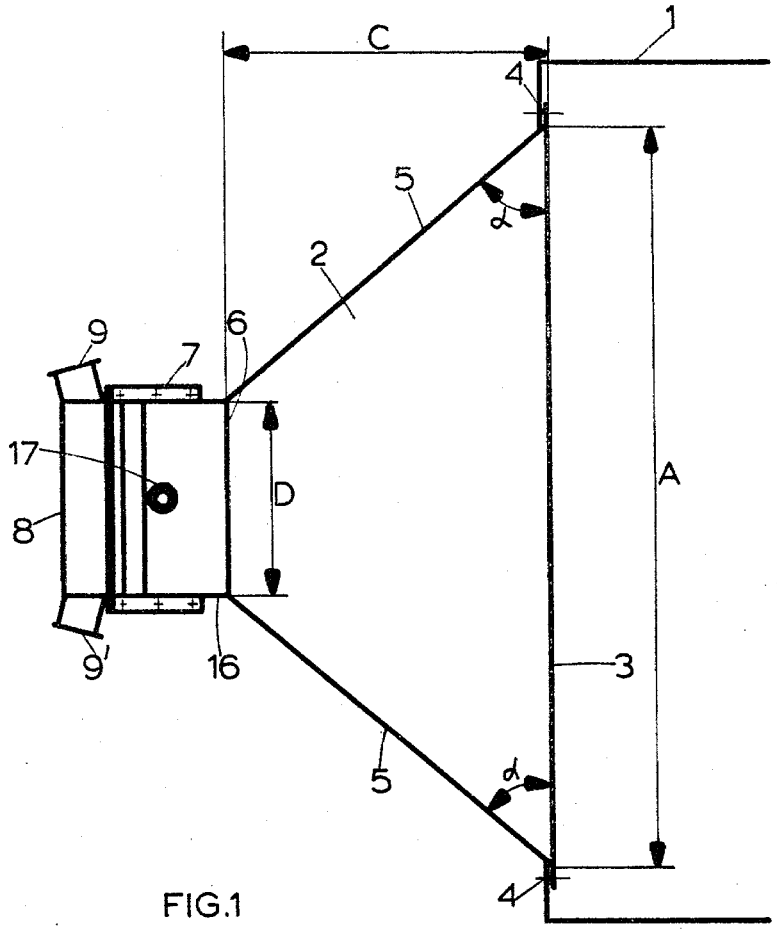
FIG. 1 shows a diagrammatic top plan view of the rear portion of the bulk container and the discharge chute assembly.

Turning now to the figures, FIG. 1 shows a top plan view of the container 1 to which the discharge chute assembly, generally indicated by numeral 2, is attached by means of flanges 4 and bolts (not shown) so that the opening of the discharge chute assembly 2 lies directly over and in alignment with flow aperture 15 provided in the rear or end wall of container 1.

Figure 2:
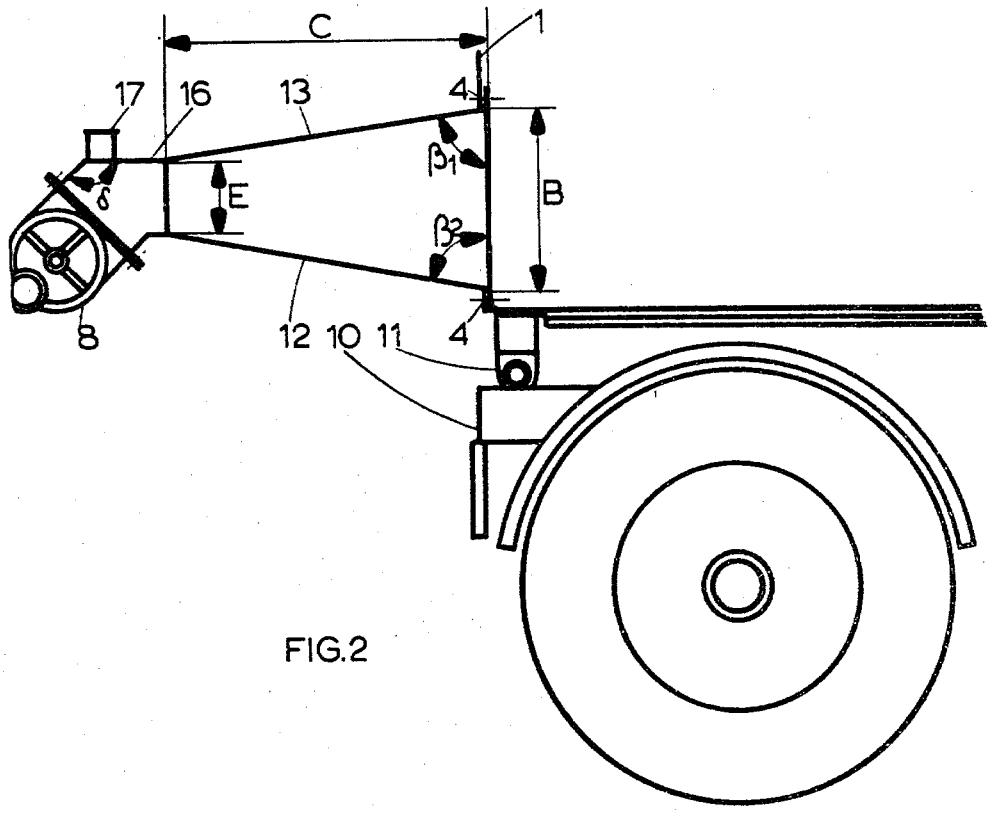
FIG. 2 shows a diagrammatic side elevational view of the assembly shown in FIG. 1.

The discharge chute assembly 2 is comprised of three sections or portions including a hopper portion, a connector portion 16, and a rotary pump assembly. The hopper portion is comprised of top and bottom wall members 13 and 12 respectively together with side walls or side members 5. A shown in FIG. 1, sides 5 each form an angle between them and the front face 3 of hopper portion with angle preferably ranging from about 40° to about 55°. As shown in FIG. 2, the bottom and top walls, 12 and 13 respectively, of hopper portion 22 also are angled with respect to the front face 3 of the hopper portion or more precisely with the plane of the opening into portion 22. These angles, designated by $\beta 1$ and $\beta 2$, are preferably within a range of about 70° to about 90°. In a preferred embodiment angle $\beta_2$ is 90° and angle $\beta_1$ between 70° and 85°. In another embodiment the angles $\beta_1$ and $\beta_2$ are equal on within a range of 70° to 85°.

As shown in FIG. 1, the hopper portion is provided with a discharge aperture, generally indicated at 6, which leads directly to connector portion 16.

As will noted in FIG. 2, the two parts of the connector portion 16 are at an angle with respect to each other which angle is designated by the letter $\delta$ and preferably from 110° to about 150°. Accordingly, the planes defined by the aperture which are in turn defined by the wall structure of connector portion 16 are also at an angle with respect to each other.

A rotary housing is connected to connector portion 16 by means of flange 7 and a rotary pump 8 is provided within the housing. Connected to the sides of housing 8 are connections 9 and 9' which, respectively, allow transport air into the rotary pump and through which the powder and air mixture will flow.

Figure 3:
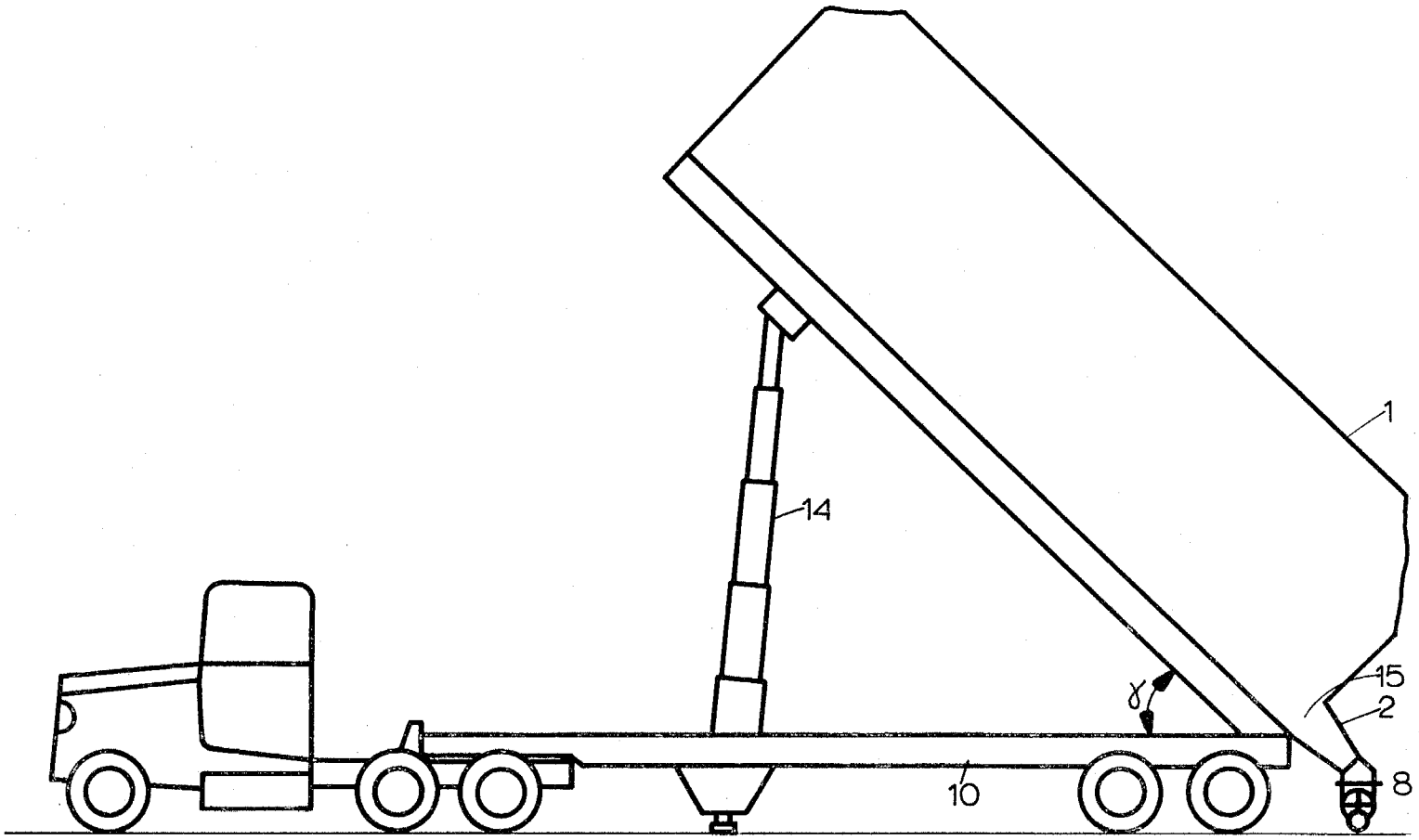
FIG. 3 shows a diagrammatic side elevational view of a tractor trailer in an unloading position with the discharge chute assembly attached.

Turning more specifically to FIGS. 2 and 3 the container or trailer truck 1 rests on a trailer frame 20 and is pivotally connected thereto by hinge 11. Connected between the frame 10 and container 1 is a suitable lifting means such as a hydraulic lift shown at 14 which is used to raise container 1 to a predetermined angle designated by the letter ($\gamma$). The angle with respect to the horizontal plane of the frame 10 is of a predetermined degree so that the melamine can be completely unloaded by way of the discharge chute assembly 21. Preferably angle ($\gamma$) will vary from about 35° to about 45° from horizontal so that within this range the optimal angle can be obtained to effectively allow all of the melamine powder to be unloaded at high speed from container 1. As indicated, any suitable lifting means can be used to lift or tilt container 1 and this includes even placing a trailer on a ramp constructed at a predetermined angle so that the container itself will be at a correctly angled position.

The width of front face 3 of hopper portion 2 is designated by the letter (A) where as the breadth of discharge aperture 6 is designated by the letter (D). The length the hopper portion is designated by the letter (C). According to the preferred embodiment of the present invention, as described herein, the length (C) is at most 0.5 A and preferably at least $0.25 \times A$. Length (D) is at least 0.125 A but preferably 0.25 A. Additionally, length (D) is generally at most 0.5 A.

The vertical height of the walls of the hopper portion at the point they connect with container 1 are designated by the letters (B) and (E) respectively and the ratio of (B) to (E) is preferably greater than 1 to 6 and more particularly 1 to 3 but in any event not more than 2 and 3.

As indicated in the above described drawings the discharge chute assembly preferably has a rectangular shape. However, if one uses a round hopper the angles $\beta 1$ and $\beta 2$ will be equal to angle $\alpha$.

In another embodiment flanges 4 could extend behind the edges of the corresponding aperture in the rear wall of the container. In this way, the discharge chute assembly could be placed in position very easily where there is no risk of the hopper becoming detached during the unloading process since the weight of the melamine would hold the flanges in their position.

It should also be kept in mind that as is usually the case when transporting cargo in ISO-Containers a liner is used within the container with the liner normally being a film of a polymer, such as low density polyethylene. This liner can be preformed or can be allowed to acquire the shape of the container but in either instance prevents cargo from contacting container walls. As is normally the case, after unloading a bulk cargo the liner is easily removed making the container ready for any other type of cargo and a careful cleaning of melamine from the container is, accordingly, not necessary.

The process of the present invention involves initially the step of correctly placing the discharge chute assembly 2 on the back of the bulk container 1 so that the aperture provided in the discharge chute assembly 2 aligns with and overlies the out flow aperture 15 provided in the rear wall of container 1. After the discharge chute assembly 2 is in its proper position on container 1, the container can be raised by any suitable device such as the hydraulic ram 14. The discharge chute assembly 2 is constructed as indicated above and with these particular size ratio and angles for the various portions of the discharge chute assembly 2 as the container 1 is raised melamine powder will flow from container 1 into the hopper portion so that unloading can commense.

The rotary pump 8 is a known element and is comprised of a housing in which the pump itself is rotatably mounted by an axle from which a plurality of blades extend. As the powder flows into and through the hopper portion and connector portion 16 it will finally reach the rotary pump assembly 8 where the rotating blades serve to additionally transport powder toward discharge connection 9' by means of the above described pneumatic transport. Thereafter, powder can be received by any convenient vessel or conveyor system by which it can be easily transported to a warehouse for storage and ultimate use.

With this apparatus and process the present invention provides a surprisingly efficient and effective method for removing melmine powder from bulk containers and allows it to be transported without the numerous problems heretofore encountered when attempting to handle melamine in this practice. In addition, it has made the loading procedures for bulk containers very easy when dealing with melamine powders. The discharge chute assemblies 2 are removably attachable to containers so that they can either be carried with the container or can be moved from container to container.

To provide additional examples of the present invention the following illustrative examples are set forth.

EXAMPLE 1

To a container as described in the drawing, containing some 18 tons of melamine a hopper was connected, of which hopper the angle was 50°, and the angles $\beta 2$ and $\beta 1$ were both 80°. The ratio C/A was 0.44, the ratio D/A was 0.27 and the ratio E/B was 0.44. A rotary pump was by way of connection 16 (with $\delta = 140°$) connected to aperture 6.

The container was lifted to an angle of 45° with the horizontal plane, whereafter the rotary pump was started. The container was unloaded without failure with a speed of 5 kg. melamine per second.

COMPARATIVE EXAMPLES II AND III

An experiment as in Example 1 was carried out whereby the angles alpha of the sides of the hopper and the backside of the container were 35°, instead of 50°. Already after a few seconds the hopper was completely clogged. Even after repeated tries the melamine could not be removed from the container.

In another experiment whereby the rotary pump was connected to aperture 6 by way of a flexible line with the same dimensions as aperture 6 but with a length equal to ½ C. the same problems arose.

What is claimed is:

1. A process for unloading melamine powder from a bulk container provided with a rear wall having an openable discharge aperture in that rear wall said process comprising the steps of attaching a discharge chute to the rear wall of the container in alignment with the discharge aperture, opening the discharge aperture, tilting the bulk container to induce flow of melamine powder within the container and from the discharge aperture, and maintaining the flow of melamine powder through the discharge aperture and through the discharge chute toward a predetermined discharge point with the flow of melamine powder being maintained because of the angled relationship of the walls of the discharge chute with respect to the plane defined by the front face of the discharge chute wherein the angle between the top and bottom walls and the front face range from about 70° to about 90° and where the angle between the side walls and the front face range from about 40° to about 55° and wherein the container is tilted at an angle ranging from about 35° to about 45°.

2. The process as in claim 1 wherein the discharge chute includes a hopper portion having a receiving and discharge aperture wherein the ratio of the length of the hopper to the width of the receiving aperture does not exceed a ratio of about 1 to 2.

3. The process as in claim 2 wherein the width of the dishcharge aperture is at least one eighth the width of the width of the receiving aperture.

4. The process as in claim 2 wherein the width of the discharge aperture is preferably one quarter the width of the receiving aperture.

5. A process as in claim 2 wherein the height of the discharge aperture is at least one sixth the height of the receiving aperture.

6. A process as in claim 5 wherein the height of the discharge aperture is about one third of the height receiving aperture.

7. A process as in claim 2 wherein the discharge chute includes a connecting member comprised of first and second angled wall sections with the angle between these wall sections ranging from about 30° to about 70° with respect to each other.

8. An improved discharge chute assembly for use in unloading melamine powder from bulk containers where such bulk containers are provided with discharge openings in at least one wall thereof, said discharge chute assembly comprising means for removably attaching said bulk discharge chute assembly to said container, hopper means for initially receiving flow of melamine powder from said bulk container, a pump means for assisting in discharging melamine powder from the discharge chute assembly and connector means for connecting said pump means to said hopper means so that a predetermine angular condition is established therebetween, wherein the hopper portion is comprised of top, bottom, and side walls that define entrance and discharge apertures in the front and rear faces respectively of said hopper portion wherein the walls of said hopper portion are arranged at predetermined angles with respect to plane defined by the entrance aperture with the angle between the top and bottom walls and the front face ranging from about 70° to about 90° and the angle between the side walls and the plane defined by the entrance aperture ranging from about 40° to about 55°.

9. A device as in claim 8 wherein the ratio of the length of the hopper discharge aperture with the length of the entrance aperture does not exceed 1 to 2.

10. A device as in claim 8 wherein the width of the hopper discharge aperture is greater than one eighth the width of the entrance aperture.

11. A device as in claim 8 wherein said connector means is comprised of an outer housing having two connector side walls which support and are separated by an upper and lower wall structure.

12. A device as in claim 11 wherein said upper and lower wall structure each include a pair of connected wall sections wherein one section in each pair extends away from said discharge aperture and is respectively attached to the top and bottom wall with the other section in each pair being secured to said pump means and positioned at an angle with respect to said one section which varies from about 110° to about 150°.

13. A device as in claim 12 wherein said one section in each pair is positioned so as to substantially be normal to the plane defined by the hopper means discharge aperture.

14. An improved discharge chute assembly for use in unloading powder from bulk containers provided with discharge openings in at least one wall thereof, said discharge chute assembly comprising means for removably attaching said discharge chute assembly to said container, hopper means for initially receiving the flow of powder from said container, said hopper having top, bottom and side wall members defining entrance and discharge apertures and arranged at predetermined angles with respect to the plane defined by said at least one wall of said container with the angle between the top and bottom walls and said at least one wall ranging from about 70° to about 90° and the angle between the side walls and said at least one wall ranging from about 40° to about 55°, pump means for assisting in the discharge of powder from the discharge chute assembly and connector means for connecting said pump means to the discharge side of said hopper means and for establishing a predetermined angular condition therebetween in a direction away from a plan normal to the plane defined by the discharge aperture, said connector means extending outwardly from said discharge aperture and being comprised of two side members, each being secured to one of said side walls and said pump means, and a pair of top and bottom members, one member in each pair of top and bottom members being respectively secured to said top and bottom walls so that they are each substantially normal to the plane established by said discharge aperture, the other member in each pair being secured to the inlet of said pump means and said one member so that the angle between the pair of members ranges from about 110° to about 150°.

15. A device as in claim 14 where the ratio of the length of the hopper discharge aperture with the length of the entrance aperture does not exceed 1 to 2.

16. A device as in claim 14 wherein the width of the hopper discharge aperture is greater than one eighth the width of the entrance aperture.

* * * * *